United States Patent [19]

Koleilat

[11] 4,121,660

[45] Oct. 24, 1978

[54] WELL PRESSURE TEST PLUG

[75] Inventor: Bashir M. Koleilat, Spring, Tex.

[73] Assignee: FMC Corporation, San Jose, Calif.

[21] Appl. No.: 826,805

[22] Filed: Aug. 22, 1977

[51] Int. Cl.[2] ..... E21B 33/03

[52] U.S. Cl. ..... 166/135; 166/123; 166/183

[58] Field of Search ..... 166/123, 135, 183, 188

[56] References Cited

U.S. PATENT DOCUMENTS

| | | | |
|---|---|---|---|
| 3,250,331 | 5/1966 | Boyle | 166/135 |
| 3,633,670 | 1/1972 | Brown | 166/135 |
| 3,897,824 | 8/1975 | Fisher | 166/188 |
| 4,007,783 | 2/1977 | Amancharla et al. | 166/135 |
| 4,018,276 | 4/1977 | Bode | 166/183 |

*Primary Examiner*—Ernest R. Purser
*Attorney, Agent, or Firm*—Lloyd B. Guernsey; W. William Ritt, Jr.; John F. Verhoeven

[57] ABSTRACT

A test plug for use in pressure testing a Christmas tree and blowout preventer atop an oil or gas wellhead. The test plug includes a cylindrical body having an outer diameter slightly smaller than the bore of the wellhead, and a plurality of support dogs that fit into an annular groove in the wellhead to support the plug during pressure testing. The plug is landed on a relatively narrow shoulder in the bore of the wellhead and the dogs are then extended into the groove by vertical movement of a mandrel, thereby lifting the plug off the shoulder and securely supporting it in test position.

8 Claims, 4 Drawing Figures

WELL PRESSURE TEST PLUG

BACKGROUND OF THE INVENTION

1. Field of the Invention

The present invention relates to apparatus for pressure testing oil or gas well equipment, and more particularly to test plugs of a type used to test Christmas trees and blowout preventers mounted on wellheads.

2. Description of the Prior Art

Blowout preventers are used on wellheads during oil and gas well drilling operations to prevent uncontrolled escape of crude oil and/or natural gas from the well which could occur when relatively high pressure is encountered in the well. The blowout preventer also serves to retain oil and/or gas within the well once it has been drilled, and Christmas trees contain valves which are used in testing the well and in controlling flow from the well. Test plugs are employed to seal off a space adjacent to the blowout preventers and the Christmas tree so that fluid under pressure can be used to pressure test these devices.

Conventional test plugs are adapted to be fitted to the end of a drill pipe string so that they may be inserted into the bore of the wellhead and removed from that bore by respectively lowering and raising the drill string. Those test plugs are landed and seated upon a relatively wide annular shoulder or other similar abutment within the bore of the wellhead and include a sealing ring which is adapted to engage the bore of the wellhead to effect a seal between the plug and the bore. Since the annular shoulder must be wide enough to support the plug when it is subject to relatively high test pressures, the shoulder constitutes a very desirable limitation on the size of the well tools or other equipment that can be passed through the wellhead.

For example, one such prior art test plug is described in U.S. Pat. No. 4,018,276 issued Apr. 19, 1977 to R. E. Bode. The Bode test plug is landed on a relatively wide annular shoulder of a seal assembly that is positioned inside the bore of the wellhead, and the plug remains on this broad shoulder throughout the testing procedure. A disadvantage of this apparatus is that the seal assembly shoulder significantly reduces the bore diameter inside the wellhead, and thus decreases the cross-sectional area through which well tools, etc., can be passed, and also limits the size of the production tubing that can be lowered through the wellhead. If the width of the annular shoulder is reduced, high pressure above the plug can cause it to be forced off the shoulder and move downwardly into a lower portion of the wellhead where it could become stuck and thus be difficult to retrieve.

SUMMARY OF THE INVENTION

The present invention overcomes some of the disadvantages of the prior art by providing a test plug that is supported in its functional position in an annular groove in the bore of the wellhead, rather than on a wide shoulder in that bore. The test plug includes a generally cylindrical body having an outer diameter slightly smaller than the bore of the wellhead, a plurality of support dogs which are carried in windows in the body, and a mandrel for actuating the dogs. The dogs are retracted while the test plug is lowered into testing position in an area adjacent the wellhead's annular groove, and the mandrel is then moved down behind the dogs, causing them to move radially outward into the annular groove thereby securely locking the test plug in its testing position. A means is provided for sealing the space between the wellhead bore and the outside of the cylindrical body of the test plug, so that the space above the plug can be pressurized to test the blowout preventer for leakage.

Since the dogs and the groove provide support for the plug during testing operations, a wide annular support shoulder of the type required by the prior art apparatus is not needed in the present invention. The engaged dogs limit movement of the plug and provide support for the plug when pressure is applied to the bore above the plug.

DESCRIPTION OF THE PREFERRED EMBODIMENT

Figure 2:
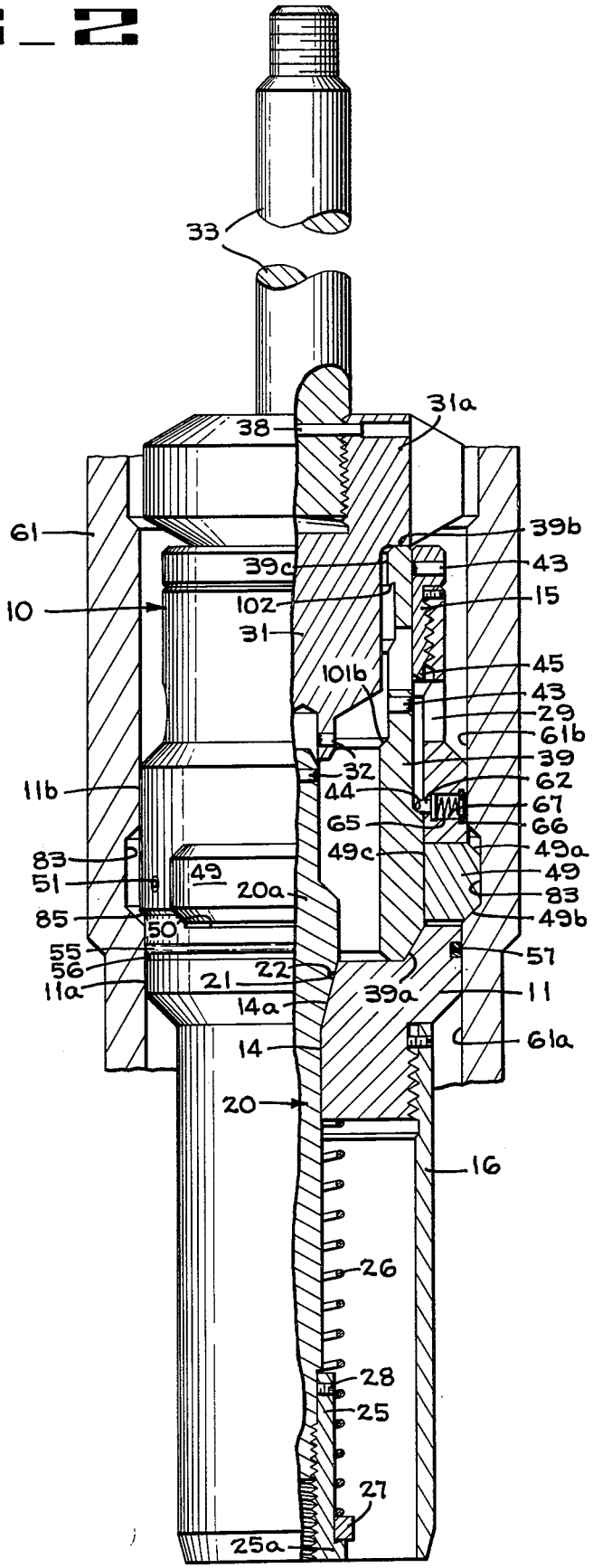
FIG. 2 is a side elevation partially in section, of the casing hanger, running tool and test plug of FIG. 1, with the test plug valve in its closed position and the plug locked in the wellhead.

Referring to the figures of the drawings, a test plug according to the present invention is diagrammatically illustrated at 10, and comprises a generally annular body 11 having an axial bore 14 extending through the lower portion thereof. The upper porton 14*a* of the bore 14 is tapered to a larger size at the upper end. The upper end of the body 11 is threaded to an annular cap 15, and the lower end of the body 11 is threaded to an annular spring housing 16. An elongated generally cylindrical stem assembly 20 includes an enlarged portion 20*a* machined to mate with the upper portion 14*a* of the bore 14. A nylon seal ring 21 in an annular groove 22 on the enlarged portion 20*a* provides a fluid-tight seal between the stem assembly 20 and the bore 14 of the annular body 11 when the stem assembly is seated in the bore 14 (FIG. 2).

The lower end of the stem assembly 20 is threaded to an elongated nut 25 having an enlarged portion 25*a* at the lower end thereof. A compression spring 26 is mounted around the body of the nut 25 and is compressed (FIG. 1) between the lower end of the body 11 and a retainer ring 27. The retainer ring is used with some sizes of plugs in which the spring is not long enough to provide the desired tension on the stem assembly, and may be omitted in some other sizes of plugs. All of the parts which are threaded to other parts are locked into position by a plurality of set screws 28.

A running tool 31 (FIG. 1) is connected to the upper end of the stem assembly 20 by a shear pin 32, so that the running tool may be removed by shearing this pin when the test plug has been locked into a test position. Two diametrically opposed lateral ports 34 in the upper portion of an annular mandrel 39 facilitate removal of the shear pin section when the lower end of the running tool is aligned with these ports. The running tool 31 is threaded or otherwise connected to the lower end of a short rod 33 that is threaded at its upper end for connection to a sucker rod string (not shown), which string is employed to run and retrieve the tool into and from a wellhead 37. A pin 38 prevents the rod 33 from rotating relative to the running tool so that the rod will not separate from the tool while the tool is being used.

The annular mandrel 39 is slidably mounted inside the upper portion of the body 11, and the mandrel is attached to the cap 15 by a plurality of shear pins 43 which prevent movement of the mandrel relative to the body 11 until these pins 43 are sheared. The lower end 45 of the cap 15 cooperates with a shoulder 44 on the mandrel 39 to prevent the mandrel from being pulled from the body 11 while the plug is being retrieved from the wellhead 37.

Figure 1:
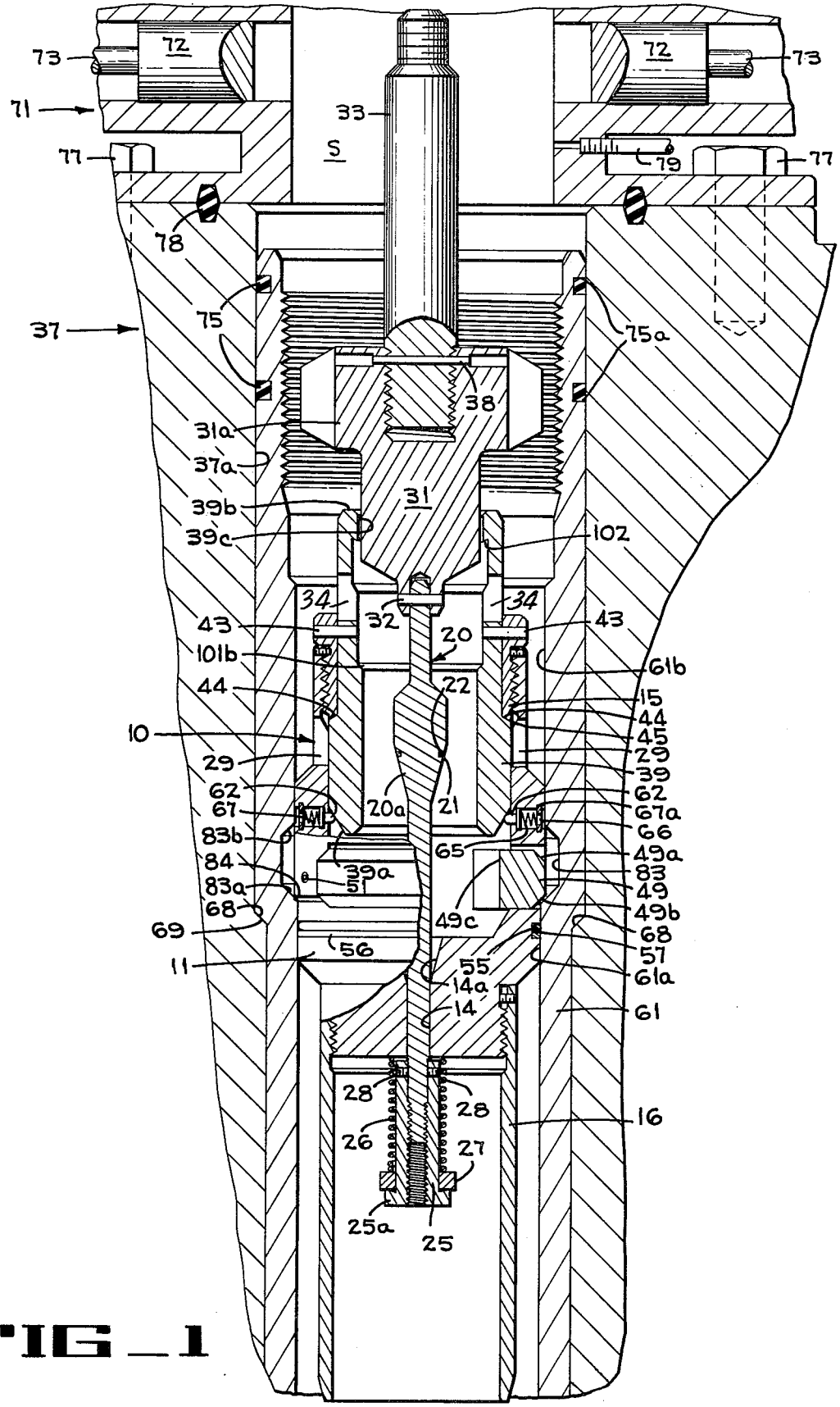
FIG. 1 is a vertical section, diagrammatically illustrating a wellhead, a blowout preventer mounted on the wellhead, a casing hanger supported in the wellhead, a test plug according to the present invention landed in the casing hanger, and a running tool connected to the test plug.
Figure 3:
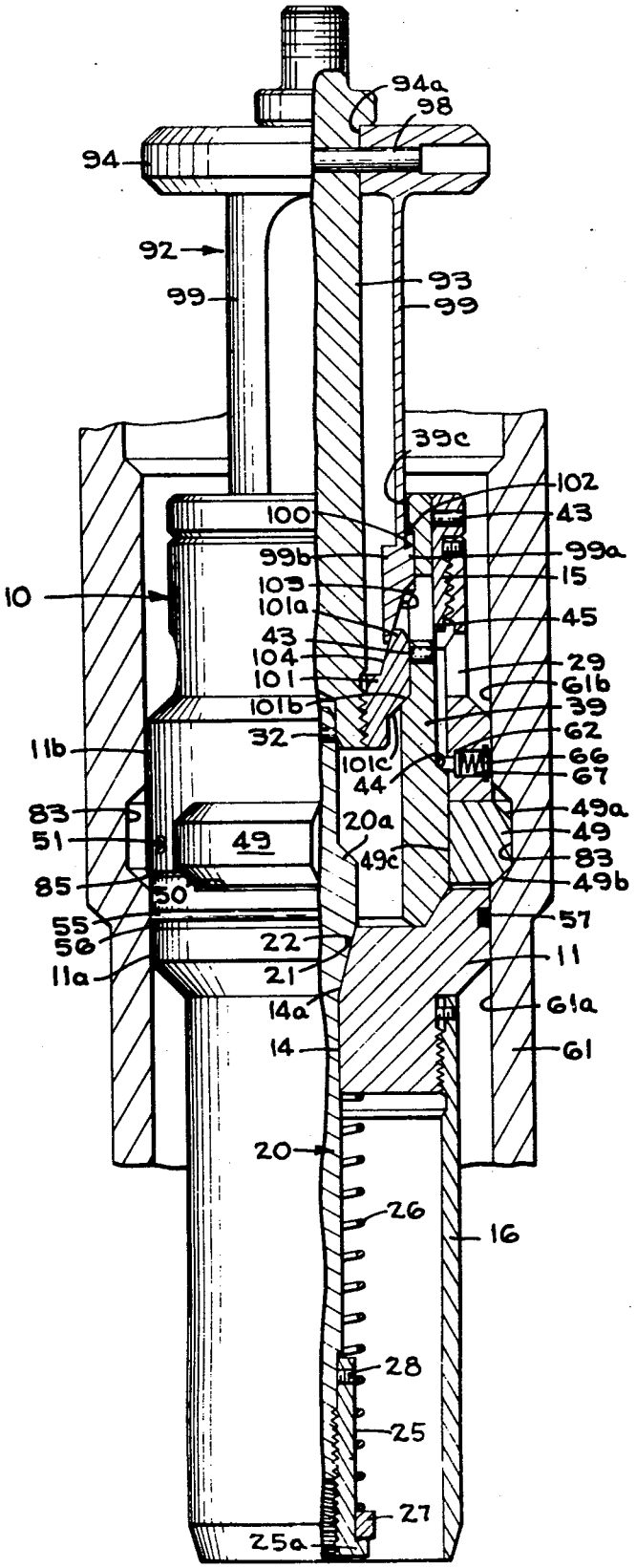
FIG. 3 is a side elevation partially in section showing the casing hanger and test plug of FIG. 2, and a retrieving tool connected to the plug.
Figure 4:
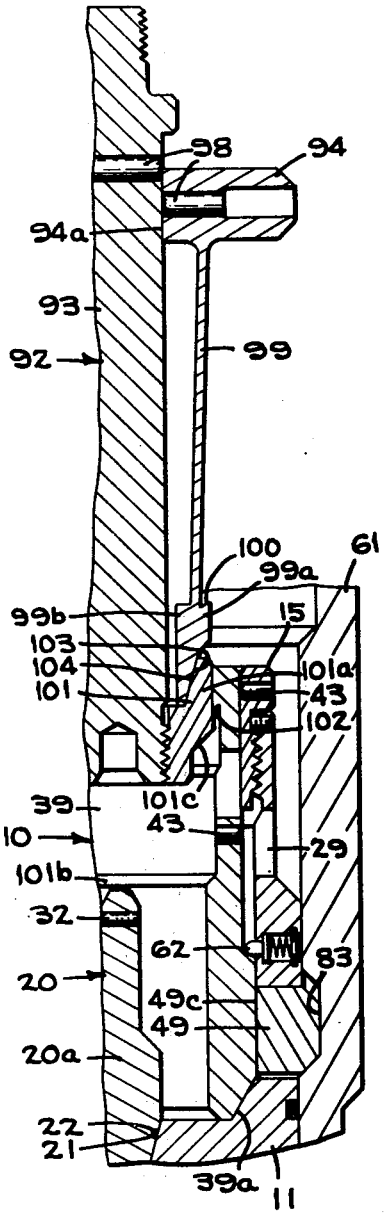
FIG. 4 is a fragmentary section showing the retrieving tool of FIG. 3 disengaged from the test plug.

A plurality of support dogs 49, with upper and lower beveled cam surfaces **49*a*, 49*b*, respectively, are loosely retained in equally spaced slots or windows 50 (FIGS. 2, 3) in the wall of the body 11 by roll pins 51. The dogs 49 are free to move radially between their innermost or retracted position as shown in FIG. 1, and their outermost or extended position as shown in FIGS. 2, 3 and 4**.

An annular O-ring 55 and an annular non-extrusion ring 56, both positioned in an external annular groove 57 on the lower part of the body 11, provide a fluid-tight seal between the body of the test plug and an outer well element, such as a hanger 61 (FIG. 2). The O-ring 55 actually provides the sealing function, while the ring 56 prevents extrusion of the O-ring 55 at high pressures and also keeps the O-ring from snapping out of the groove 57 due to sudden expansion of the ring, which expansion could occur if test fluid suddenly flows past the O-ring as the test plug is pulled out of the bore of the hanger 61.

A plurality of rivets 62 (FIGS. 1, 2) retain the mandrel 39 in a locked position (FIG. 2) after the shear pins 43 have been broken and the mandrel is moved down into the locked position. Each of the rivets 62 is biased in a radially inward direction by a spring 65 which is retained in a recess 67 in the body 11 by a retainer ring 66. The retainer ring snaps into an annular groove **67*a* in the recess 67**.

The wellhead includes an annular bore **37*a* with an inwardly extending beveled shoulder 68. The hanger 61 is sized to fit within the bore of the wellhead, and includes an annular shoulder 69 sized to uniformly engage and be supported by the wellhead's inwardly extending beveled shoulder 68. A plurality of annular seals 75, positioned in grooves 75*a* in the outer surface of the hanger 61, provide a fluid-tight seal between the wellhead 37 and the hanger 61. In the illustration in FIG. 1, the wellhead 37 is surmounted by a blowout preventer system 71 having a set of rams 72 and closing means 73, although other types of blowout preventers may be used. The blowout preventer system is connected to the wellhead by a plurality of bolts 77 and sealed by an annular sealing ring 78. Pressurized hydraulic fluid for testing the blowout preventer is supplied into the space S below the rams 72 by a choke and kill line 79**.

In the inner wall of the hanger 61 is an annular groove 83 that receives the support dogs 49 when the plug 10 is locked into the testing position. The diameter of the hanger bore below the groove at **61*a* is slightly less than the diameter of the bore at 61*b* above the groove, so that the lower portion of the groove's lower beveled surface 83*a* constitutes a very narrow shoulder 84. As seen in FIGS. 2 and 3, the outside diameter of the plug body at 11*a* below the slots or windows 50 is slightly less than the diameter of the upper portion of the body at 11*b*, and between these two body surfaces is an annular upwardly and outwardly extending conical surface 85. The shoulder 84 functions as a temporary seat upon which the plug surface 85 is landed during installation, as shown in FIG. 1. In this temporary location the support dogs 49 are adjacent to, but slightly below, the groove 83. The shoulder 84** is too narrow to adequately support the test plug when test pressure is applied, and thus this shoulder serves only to stop the plug in proper position in the hanger or other well element as it is being installed, and not during pressure testing.

The spacing between the stop shoulder 85 on the test plug 11 and the windows 50 in which the dogs are retained is very important. If the dogs are positioned too high relative to the shoulder 85 when the dogs are expanded, the surface **49*b* of the dogs will not slide upward along the surface 84 of the groove 83 and the test plug 11 will not be lifted off the stop shoulder 84. On the other hand, if the dogs are positioned too low relative to the shoulder 85 the expanding dogs will strike the inside wall 61*a* of the hanger 61 and will not slide into the groove 83**.

The procedure for installing the test plug 10 in the wellhead system illustrated in the drawings is as follows. The blowout preventer rams 72 are opened so that the test plug and the running tool 31 can be lowered into the wellhead 37 by the sucker rod string (not shown) which is attached to the rod 33 of the running tool. The test plug, with its mandrel 39 secured by shear pins 43 in the elevated position and the dogs 49 retracted inwardly as shown in FIG. 1, is then lowered through the blowout preventer and into the wellhead and casing hanger, until the surface 85 on the plug body 11 lands on the annular shoulder 84 of the hanger 61. During the lowering process the nut 25, compression spring 26 and the lower end of the stem assembly 20 are protected by the spring housing 16 from possible collision with portions of the wellhead.

When the surface 85 of the plug 10 lands on the shoulder 84 of the hanger 61, downward movement of the plug body 11 stops, but sucker rod string and the running tool continue to move downward until the centralizer portion **31*a* of the running tool contacts the upper end 39*b* of the mandrel 39. The mandrel is then jarred downward inside the body 11, shearing the pins 43**.

As the mandrel 39 moves downward, the rivets 62 are forced outward by the mandrel's annular cam surface **39*a*. Further downward movement of the mandrel causes the cam surface 39*a* to contact the upper inner edge 49*c* of the dogs 49 and additional downward movement forces the dogs outward into the groove 83 of the hanger 61. As the dogs move outward their lower cam surfaces 49*b* engage and then move along the lower beveled surface 83*a* of the groove 83, causing the dogs to move upward in the groove and to lift the plug 10 off the shoulder 84 as described hereinbefore. Downward movement of the mandrel continues until its lower end comes to rest on the upwardly facing opposing surfaces of the tool body 11 (FIGS. 2, 3 and 4), and during the final stage of this movement the rivets 62 move inwardly in response to the bias of the springs 65** to lock the mandrel in place. In this final position, the mandrel locks the dogs in their outer plug-supporting position, and the plug is thus in position for pressure testing.

The running tool 31 is then pulled upward, and since the plug body 11 is locked in testing position only the stem assembly 20 moves up with the tool. This upward movement of the assembly 20 continues until the elongated nut 25 contacts the lower end of the body 11, at which time further upward movement of the assembly is prevented. As the running tool 31 continues to move upward the shear pin 32 shears thus disconnecting the running tool from the stem assembly 20 and allowing the compression spring 26 to pull the enlarged portion 20*a* of the stem assembly downward and seat it in the bore 14*a* of the body 11 (FIG. 2). The rod string is then lifted to withdraw the runing tool 31, the preventer rams 72 are closed, fluid is pumped into the space S through the choke and kill line 79 to pressure test the blowout preventer in the usual manner.

In order to retrieve the test plug after the blowout preventer has been tested, a retrieving tool 92 (FIGS. 3 and 4) is used. The retrieving tool includes an elongated annular stem 93 with an upper end threaded for connection to a sucker rod string (not shown). An annular centralizer 94, having an axial bore 94*a* surrounds the upper end of the stem 93 with the body of the stem extending through the centralizer bore and a shear pin 98 secures the centralizer 94 to the stem 93. A plurality of leaf springs 99 extend axially downward from the centralizer 94 and these springs and the centralizer preferably are machined from a single piece of material. The lower end of each of the leaf springs includes an outwardly extending flange 99*a* and an inwardly extending flange 99*b* having an outer cam surface 103. The flange 99*a* includes a shoulder 100 which makes contact with an annular shoulder 102 in the bore of the mandrel 39 to enable the retrieving tool to grip the mandrel and impart an upward force thereon during the retrieval operation. An annular nut 101, having a generally radially extending flange 101*a*, is threaded to the lower end of the stem 93. The flange 101*a* includes a cam surface 104 which presses against the cam surface 103 of the leaf springs 99 to provide radially inward deflection of the springs so that the lower ends of the leaf springs may be moved inside the mandrel 39.

During the retrieval operation the centralizer 94 centers the retrieving tool 92 (FIG. 3) inside the wellhead as this tool is lowered into position for connection to the test plug 10. The beveled surface 101*b* on the mandrel cooperates with the beveled surface 101*c* on the nut 101 to limit the downward travel of the retrieving tool, at the position shown in FIG. 3. The nut 101 also functions to guide the retrieving tool 92 into the bore of the mandrel 39.

As the tool 92 is lowered into the bore of the mandrel 39 the cam surfaces 103 of the leaf springs 99 contact the inner wall 39*c* of the mandrel, causing the leaf springs 99 to flex radially inward so that the flanges 99*a* are guided into the mandrel bore. When the flanges 99*a* have been lowered to a point below the shoulder 102 of the mandrel, the retrieving tool 92 is raised until the shoulders 100 of the leaf springs 99 contact the mandrel shoulder 102. Further upward movement of the retrieving tool 92 causes the shoulders 100, 102 to pull upward on the mandrel 39 (FIG. 3), so that the mandrel 39 moves upward into the position shown in FIG. 1, thereby unlocking the dogs 49. Continued upward movement of the retrieving tool picks up the test plug 10 and causes the upper cam surfaces 49*a* of the dogs 49 to contact the upper beveled surface 83*b* of the groove 83. Pressure of the cam surfaces 49*a* against the groove surface 83*b* causes the dogs to move radially inward until they are out of the groove 83 and in their retracted position, thereby unlocking the test plug 10 from the hanger 61. When the shoulder 44 of the mandrel contacts the shoulder 45 of the cap 15 (FIG. 1), the entire test plug moves upwardly through the wellhead and the blowout preventer 71.

In the unlikely event that the test plug should stick inside the hanger, another means for retrieving the stuck plug is provided. If sufficient upward force is exerted on the stem 93, the shear pin 98 shears off as shown in FIG. 4. Continued upward movement of the stem 93 then causes the cam surface 104 of the nut 101 to move over the cam surface 103 of the flanges 99*a* (FIG. 4), thereby forcing the flanges 99*a* radially inward away from the annular shoulder 102 and unlocking the springs 99 from the mandrel 39. The retrieving tool 92 can then be lifted out of the hanger 61 and the wellhead. A conventional fishing tool can then be used to grip the mandrel firmly and remove the test plug.

Although the best mode contemplated for carrying out the present invention has been herein shown and described, it will be apparent that modification and variation may be made without departing from what is regarded to be the subject matter of the invention.

I claim:

1. A test plug for use in pressure testing a blowout preventer and/or a Christmas tree on a wellhead having an annular groove in the inside wall thereof, said test plug comprising:

a cylindrical body having an outer diameter slightly smaller than the bore of said wellhead;

a plurality of expandable dogs connected to said cylindrical body;

stop means for positioning said dogs adjacent said annular groove when said plug is moved into said wellhead;

cam means on said dogs for cooperation with said annular groove to lift said plug off said stop means when said dogs are expanded into said groove;

means for expanding said dogs into said annular groove when said cylindrical body is in a testing position adjacent said annular groove, said dogs and said groove locking said plug in said testing position; and means for sealing the space between said cylindrical body and said wellhead bore when said plug is in said testing position so that the space above said plug can be pressurized.

2. A test plug as defined in claim 1 wherein said cylindrical body includes an axial bore extending through said body, and a means for selectively sealing said axial bore.

3. A test plug as defined in claim 1 including means for pressurizing the space between said test plug and the portion of said wellhead which is to be tested, when said test plug is locked in said testing position.

4. A test plug as defined in claim 1 including means for retracting said dogs until said dogs are positioned adjacent said annular groove.

5. Apparatus for use in pressure testing a wellhead, said wellhead having an axially extending bore and an inner annular groove extending generally radially outward from said bore, said apparatus comprising:

a test plug having a generally cylindrical body with the outer diameter slightly smaller than the diameter of said wellhead bore;

a plurality of expandable dogs carried by said test plug;

means for stopping said dogs adjacent said annular groove as said test plug is lowered into said wellhead;

cam means on said dogs for cooperation with said annular groove to lift said test plug off said stopping means as said dogs are expanded into plug-supporting position in said groove; and means for expanding said dogs into said annular groove when said test plug is stopped adjacent said groove.

6. Apparatus for use in pressure testing as defined in claim 4 wherein said test plug has an axially extending bore, and wherein said means for expanding said dogs includes a generally cylindrically shaped mandrel slidably mounted in said bore of said plug, said mandrel including a cam surface adjacent one end thereof, said mandrel cam surface contacting said dogs to force said dogs into said groove when said mandrel is moved toward a first end of said test plug, and said cam surface moving away from said dogs to allow said dogs to move out of said groove when said mandrel is moved toward a second end of said test plug.

7. Apparatus for use in pressure testing as defined in claim 5 including means for securing said mandrel in said second end of said test plug until said dogs are positioned adjacent said groove.

8. Apparatus for use in pressure testing as defined in claim 5 wherein said dogs and said groove each include cam surfaces which cooperate to move said dogs out of said groove when said test plug is biased upward while said mandrel is positioned at said second end of said test plug.

* * * * *

UNITED STATES PATENT OFFICE

CERTIFICATE OF CORRECTION

Patent No. 4,121,660 Dated October 24, 1978

Inventor(s) Bashir M. KOLEILAT

It is certified that error appears in the above-identified patent and that said Letters Patent are hereby corrected as shown below:

Col. 2, line 66, delete "removal" and insert therefor --installation--;
line 67, delete "section" and insert therefor --32--.

Signed and Sealed this

*Fourth* Day of *December 1979*

[SEAL]

*Attest:*

SIDNEY A. DIAMOND

*Attesting Officer*

*Commissioner of Patents and Trademarks*